US006662505B2

(12) United States Patent
Heady et al.

(10) Patent No.: US 6,662,505 B2
(45) Date of Patent: Dec. 16, 2003

(54) APPARATUS AND METHOD OF STRAIGHTENING AND SUPPORTING A DAMAGED WALL

(76) Inventors: Timothy P. Heady, 505 NW. Chapel Dr., Ankeny, IA (US) 50021; Charles W. Heady, 1642 J Ave., Perry, IA (US) 50220

( * ) Notice: Subject to any disclaimer, the term of this patent is extended or adjusted under 35 U.S.C. 154(b) by 0 days.

(21) Appl. No.: 10/351,861

(22) Filed: Jan. 27, 2003

(65) Prior Publication Data

US 2003/0131555 A1 Jul. 17, 2003

Related U.S. Application Data

(63) Continuation of application No. 09/725,585, filed on Nov. 30, 2000.

(51) Int. Cl.[7] ..... E04G 21/04; E04G 21/26

(52) U.S. Cl. ..... 52/127.2; 52/126.3; 52/150; 52/151; 248/201

(58) Field of Search ..... 52/514, 125.6, 52/126.1, 126.3, 126.4, 127.2, 150, 151; 248/201, 300, 218

(56) References Cited

U.S. PATENT DOCUMENTS

| | | | | |
|---|---|---|---|---|
| 2,914,147 A | | 11/1959 | Millard | |
| 3,030,061 A | * | 4/1962 | Jennings | 248/354.3 |
| 3,095,666 A | | 7/1963 | Killen | |
| 3,817,006 A | | 6/1974 | Williams | |
| 4,068,427 A | * | 1/1978 | Camardo | 52/127.2 |
| 4,083,156 A | * | 4/1978 | Tye | 248/354.5 |
| 4,268,066 A | * | 5/1981 | Davis | 280/763.1 |
| 4,304,078 A | * | 12/1981 | Meriwether, Jr. | 52/127.2 |
| 4,872,634 A | * | 10/1989 | Gillaspy et al. | 248/354.3 |
| 4,937,989 A | | 7/1990 | Miyares et al. | |
| 5,913,787 A | | 6/1999 | Edwards | |
| 5,956,906 A | * | 9/1999 | Berich et al. | 52/149 |
| 6,073,405 A | | 6/2000 | Kasai et al. | |
| 6,112,475 A | | 9/2000 | Truitt | |
| 6,141,932 A | | 11/2000 | Tarrant | |

* cited by examiner

*Primary Examiner*—Carl D. Friedman
*Assistant Examiner*—Chi Q Nguyen
(74) *Attorney, Agent, or Firm*—McKee, Voorhees & Sease, P.L.C.

(57) ABSTRACT

A method and apparatus for supporting and straightening a wall includes two secured brackets, a beam extending between the brackets and the wall, the beam being comparable in length to the walls height. In between the beam and one of the brackets, a holding bracket is placed which includes a retaining ring. A jack extends between the secured bracket and holding bracket and is used to apply pressure to the beam and thereby to the wall. The jack may include a bolt inserted through the secured bracket to contact the holding bracket inside the retaining ring and a nut which is located on the bolt in between the holding bracket and secured bracket. By tightening the bolt, the user can apply pressure to the beam and straighten or retain the wall. As the wall shifts during periods of correction, the bolt may be re-tightened to apply additional pressure to the wall.

9 Claims, 2 Drawing Sheets

APPARATUS AND METHOD OF STRAIGHTENING AND SUPPORTING A DAMAGED WALL

BACKGROUND OF THE INVENTION

1. Field of the Invention

The present invention relates generally to an apparatus and method of repairing walls which have been damaged including cracking and bowing from hydrostatic pressure, freezing or other reasons. More particularly, the present invention relates to an apparatus and method for supporting and straightening damaged walls.

2. Problems in the Art

Basement walls tend to crack or bow for a variety of reasons. Most prior art systems tend to pull the wall back into position by providing an anchor in the soil surrounding the wall. A hole is drilled in the wall and a wire is secured to both the anchor and the wall. By pulling on the wire, the wall is suppose to be pulled back into position. However, given the varying types of soils outside of the wall, such systems are prone to failure. It is therefore desirable to provide a straightening apparatus and method which does not rely on the use of soil outside of the wall. Conventional indoor supporting and straightening devices occupy a large amount of interior space. As this has a direct impact on the utility of the basement, it is desirable to have a supporting apparatus which minimizes the intrusive effect of prior art devices.

Other prior art systems allow pressure to be applied by a user but require additional hardware to keep the device in a set position. It is therefore desirable to provide a straightening device which allows for the application and maintenance of pressure without additional hardware.

There is therefore a need for an apparatus and method for straightening and supporting damaged walls which avoids these and other problems.

Features of the Invention

A general feature of the present invention is the provision of an improved method and apparatus for supporting and straightening a damaged wall which overcomes the problems found in the prior art.

A further feature of the present invention is the provision of a method and apparatus for supporting and straightening a damaged wall which does not rely upon an anchor in soil.

Another feature of the present invention is the provision of a method and apparatus for supporting and straightening a damaged wall which takes up a minimum amount of space in the room in which the wall is located.

A still further feature of the present invention is the provision of a method and apparatus for supporting and straightening a damaged wall which can vary the amount of pressure applied to the wall.

Another feature of the present invention is the provision of a method and apparatus for supporting and straightening a damaged wall in which pressure applied to the wall may be increased to continually straighten the wall over a period of time.

This, as well as other features and advantages of the present invention, will become apparent from the following specification and claims.

SUMMARY OF THE INVENTION

The present invention generally comprises a first and second bracket. One of the brackets is secured into the basement floor. The other bracket is secured into the joist of the floor above the basement. A beam is then place between the brackets and the damaged wall. One of the brackets is placed into a position such that when the beam is installed, the beam will contact the wall. The other bracket is placed further away from the wall. When the beam is installed, there will be a gap between the beam and this bracket. In between this bracket and the beam, a jack is installed.

In a preferred embodiment, the jack of the present invention includes a holding bracket, a nut, and a bolt. The holding bracket is placed against the beam and the bolt is inserted through the secured bracket. Before the bolt contacts the holding bracket, a nut is installed on the bolt between the secured bracket and the holding bracket. By tightening the nut and bolt combination, the bolt may be extended to contact and apply pressure to the holding bracket. In turn, the holding bracket applies pressure to the beam which applies pressure to the wall. This allows the present invention to reliably apply the desired amount of pressure to straighten or support a damaged wall, while minimizing the amount of space used in the basement.

DETAILED DESCRIPTION OF THE PREFERRED EMBODIMENT(S)

The present invention will be described as it applies to its preferred embodiment. It is not intended that the present invention be limited to the described embodiment. It is intended that the invention cover all modifications and alternatives which may be included within the spirit and scope of the invention.

Figure 1:
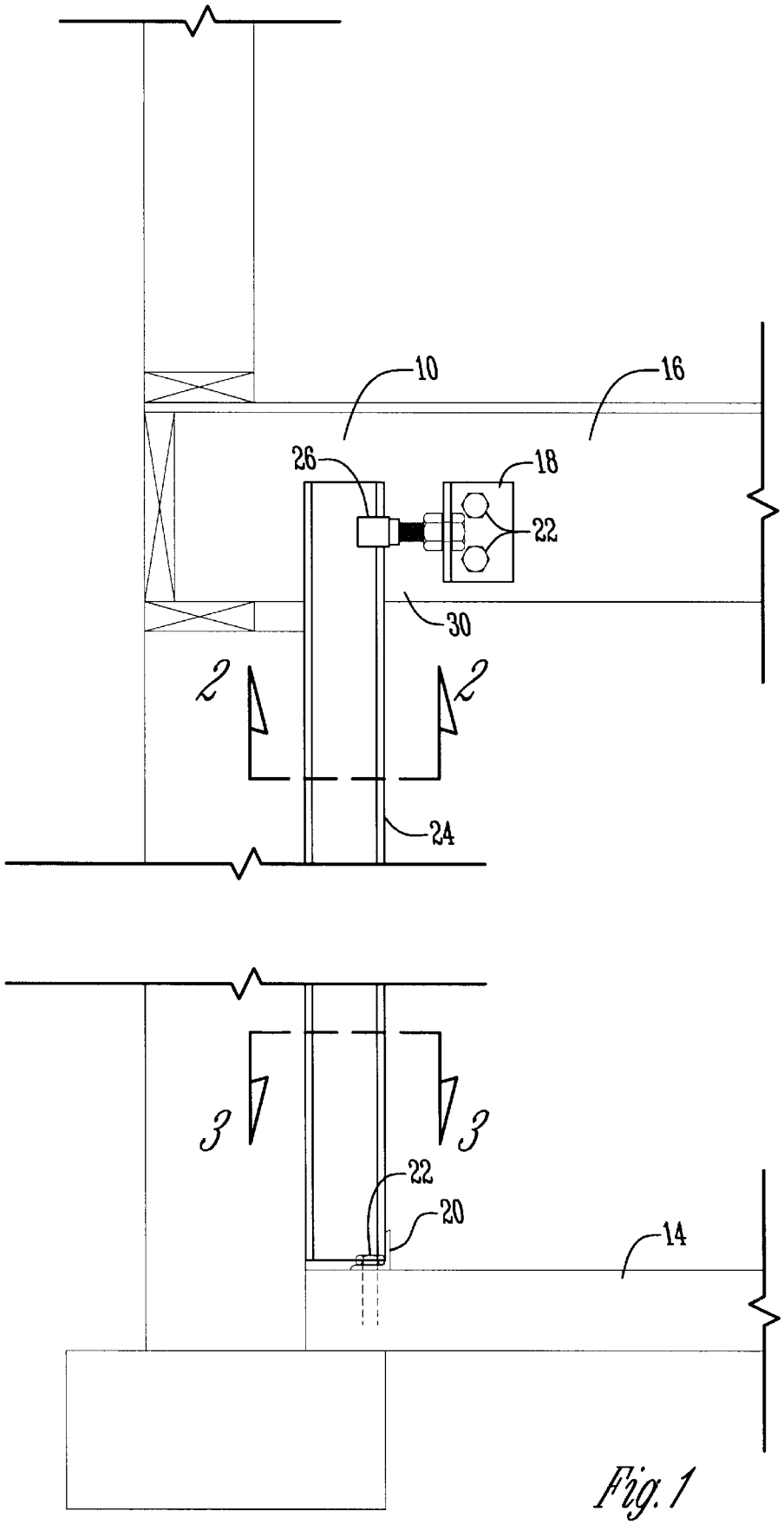
FIG. 1 is a side view of one embodiment of the present invention.

Now, referring to the drawings, FIG. 1 illustrates the bracketing system 10 for supporting and straightening a damaged wall 12. Occasionally, a basement wall 12 will crack and bulge as a result of freezing or hydrostatic pressure. To prevent this from occurring, and to correct any bulges or cracks which may have already occurred, the bracketing system 10 of the present invention is installed.

Figure 2:
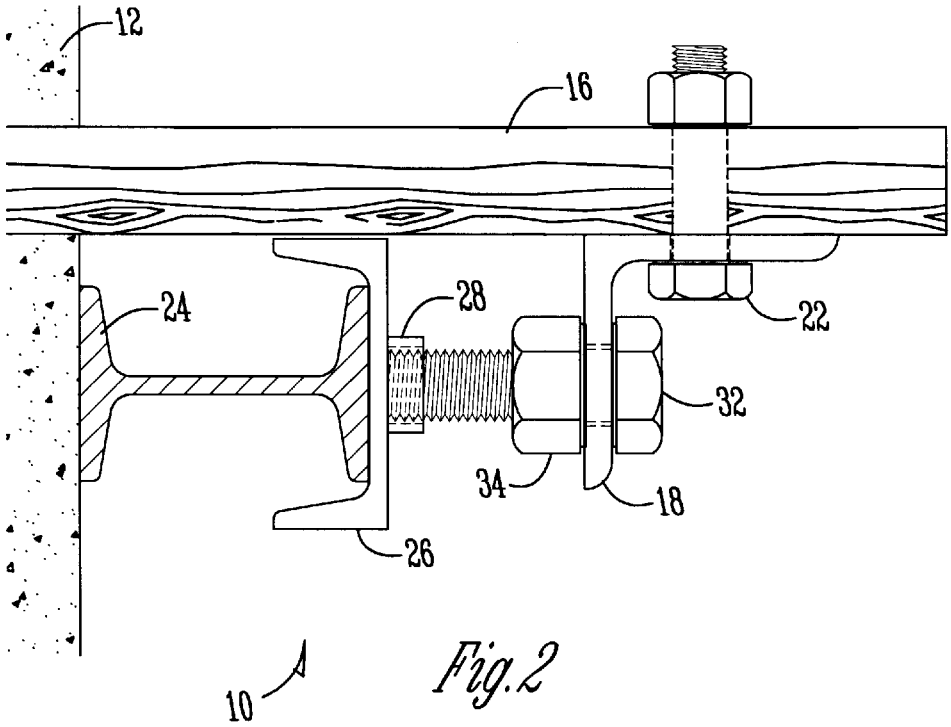
FIG. 2 is a cross-sectional view of the present invention taken along line 2—2 of FIG. 1.
Figure 3:
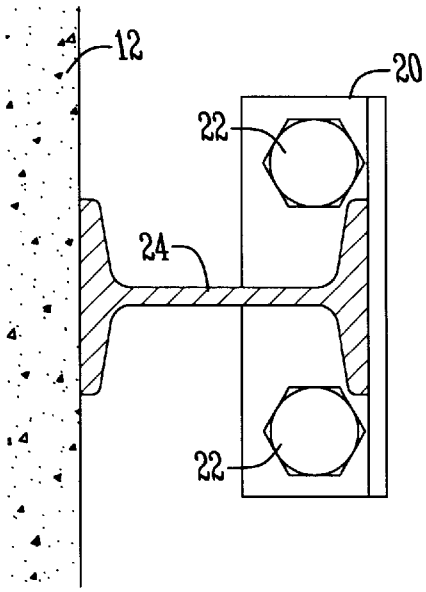
FIG. 3 is a cross-sectional view of the present invention taken along line 3—3 of FIG. 1.

The bracketing system 10 of the present invention includes two secured brackets. The first secured bracket 18 is preferably connected to a floor joist 16 which helps to form the floor support for the floor above the basement. The first secured bracket 18 is preferably a five inch long piece of three and a half inch angle iron with two 2 13/16" holes in one leg and one 1/16" hole in the other leg. Two bolts 22 fit through the two holes and secure the first bracket 18 to the floor joist 16. A second secured bracket 20 is a five and a half inch piece of two inch angle iron with 13/16 inch holes in one leg to accommodate two ¾ inch concrete anchors. Using the two concrete anchors 22, the second secured bracket 20 is mounted onto the concrete floor 14 of the basement. A beam 24, such as a four inch 7.7 per pound foot I-beam, is then placed between the first and second brackets 18, 20 and the wall 12. As can be seen in FIG. 2, a generally C-shaped holding bracket 26 is placed on the beam 24 between the beam 24 and the first secured bracket 18.

A jack 30 is then placed to operate between the first bracket 18 and the beam 24. The jack 30 is substantially or completely horizontal in order to minimize the amount of interior space needed by the jack 30. Preferably the jack 30 includes a one-inch thick bolt 32 of any desired length that is placed in the corresponding hole on the first bracket 18 to contact the holding bracket 26. The contact position of the bolt 32 on the holding bracket 26 may be insured by welding a half-inch piece of a 1 ¼ diameter pipe, or retaining ring 28, in the center of the holding bracket 26. The holding bracket 26 is preferably a 1.5 inch piece of four inch by 1 ½" inch channel. Of course other materials and means of securement may be used and are considered to be within the scope and teaching of the present invention.

As can be seen in FIG. 2, the holding bracket 26 keeps the beam 24 from shifting as pressure is applied. Pressure is applied by extending the jack. In the preferred embodiment, the jack is extended by turning the bolt 32 while holding the nut 34 in position. Alternatively of course, turning the nut 34 while holding the bolt 32 would also work. Turning the bolt 32 in a tightening fashion applies pressure to the holding bracket 26 which in turn applies pressure to the beam 24 which applies pressure to the wall 12. In this way, the wall 12 may be reinforced or gradually pushed back into position.

As the wall 12 moves back into a more straightened position, it may be necessary to apply additional pressure with the jack 30. Preferably, this may be done by simply tightening the bolt 32. In this way, the bracketing system of the present invention can be properly adjusted to work over time to straighten the wall.

The bracketing system 10 of the present invention may be used to not only straighten walls but to prevent walls from further movement. A general description of the present invention as well as the preferred embodiment of the present invention have been set forth above. Those skilled in the art to which the present invention pertains will be able to practice additional variations in the methods and systems described which fall within the teachings of this invention. Accordingly, all such modifications and additions are deemed to be within the scope of the invention which is to be limited only by the claims appended hereto.

What is claimed is:

1. A bracketing combination for supporting and straightening a wall in a room, the bracketing combination comprising:

a beam having a firs side and a second side, the beam being in contact with a wall on the first side, the beam having an upper portion and a lower portion;

a holding bracket in contact with the second side of the upper portion of the beam;

a first bracket secured to a joist and aligned with the holding bracket;

a second bracket secured to a floor, the second bracket being in contact with the second side of the lower portion of the beam; and a jack extending from the first bracket to the holding bracket.

2. The bracketing combination for supporting and straightening a wall of claim 1 wherein the beam is an I-beam.

3. The bracketing combination for supporting and straightening a wall of claim 1 wherein the jack further comprises: a bolt extending through the second bracket to contact the holding bracket; and a nut, the nut being on the bolt in between the holding bracket and the second bracket.

4. The bracketing combination for supporting and straightening a wall of claim 3 wherein the holding bracket includes a retaining ring.

5. A method of using a beam to straight a deformed wall in a room wherein the room has a top and a bottom adjacent the deformed wall, the method comprising:

securing a first bracket to the top of the room;

securing a second bracket to the bottom of the room;

placing the beam in contact with the second bracket and the deformed wall;

placing a holding bracket on the beam, the holding bracket being located near the top of the room and adjacent the first bracket; and extending the jack between the first bracket and the holding bracket to apply pressure to the beam and straighten the wall.

6. The method of straightening a deformed wall of claim 5 wherein the beam is an I-beam.

7. The method of straightening a deformed wall of claim 5 wherein the jack further comprises a bolt extending through the first bracket to the holding bracket; and a nut, the nut being on the bolt and in between the holding bracket and the first bracket.

8. The method of straightening a deformed wall of claim 7 wherein the holding bracket includes a retaining ring.

9. The method of straightening a deformed wall of claim 7 further comprising re-tightening the bolt to apply additional pressure to the beam.

* * * * *